United States Patent [19]

Mackanos

[11] Patent Number: 4,850,532

[45] Date of Patent: Jul. 25, 1989

[54] PROCESS FOR SPRINKLING LAWNS

[75] Inventor: Thomas J. Mackanos, Jupiter, Fla.

[73] Assignee: DonuTrimmer Equipment, Inc., Boynton Beach, Fla.

[21] Appl. No.: 227,638

[22] Filed: Aug. 3, 1988

[51] Int. Cl.[4] ..... B05B 17/00; B05B 3/16

[52] U.S. Cl. ..... 239/1; 239/204; 239/206; 239/242; 239/289

[58] Field of Search ..... 239/1, 204–206, 239/240, 242, 289

[56] References Cited

U.S. PATENT DOCUMENTS

| | | | |
|---|---|---|---|
| 2,595,598 | 5/1952 | Morton | 239/289 X |
| 2,668,078 | 2/1954 | Snoddy | 239/289 X |
| 3,107,056 | 10/1963 | Hunter | 239/206 |
| 3,118,609 | 1/1964 | Glover | 239/205 |
| 3,261,552 | 7/1966 | Hunter | 239/240 X |
| 3,752,403 | 8/1973 | Diest | 239/204 |

*Primary Examiner*—Andres Kashnikow
*Assistant Examiner*—Patrick N. Burkhart
*Attorney, Agent, or Firm*—Howard J. Greenwald

[57] ABSTRACT

A process for sprinkling water onto a lawn, comprising the steps of: (a) providing an in-ground pop-up sprinkler comprised of a cylindrical housing, a motor compartment structure, and rotatable sprinkler head, wherein 1. said cylindrical housing has a sprinkler compartment, a motor compartment, and an inlet communicating with said motor compartment, 2. the bottom end of said cylindrical housing is closed except for said inlet, 3. above the bottom end of said cylindrical housing, the housing forms said motor compartment, 4. above said motor compartment, said housing is radially enlarged to form said sprinkler compartment, 5. said sprinkler head is capable of limited extension and retraction, 6. when retracted, said sprinkler head is enclosed within said sprinkler head compartment formed within said housing, and 7. said sprinkler head is operatively connected to said motor compartment structure; (b) providing a valve and head sprinkler adaptor, wherein said adaptor is a circular sleeve comprised of a grooved orifice into which a pipe may be screwed and an O-ring groove around its perimeter, and wherein the diameter of said adaptor is substantially identical to the diameter of said motor compartment of said cylindrical housing; (c) removing said motor compartment structure and said rotatable sprinkler head from said cylindrical housing; (d) inserting an O-ring into said O-ring groove on said adaptor; (e) placing the adaptor with the O-ring inserted onto it into the motor compartment of said cylindrical housing; (e) attaching a pipe to said grooved orifice of said adaptor; and (f) supplying water to the inlet of said cylindrical housing.

15 Claims, 4 Drawing Sheets

PROCESS FOR SPRINKLING LAWNS

FIELD OF THE INVENTION

A process for sprinkling lawns utilzing a pop-up sprinkler is provided. In this process, the motor structure and the sprinkler head are removed from a pop-up sprinkler, an adaptor configured to fit within the motor compartment of the sprinkler housing is inserted into the housing, a pipe is attached to the adaptor, a rotary union is attached to the pipe, and a flexible hose is then attached to the rotary union.

BACKGROUND OF THE INVENTION

Pop-up sprinklers are well known to those skilled in the art, and they are often used to water golf courses. Some pop-up sprinklers which have found wide commercial acceptance are described in U.S. Pat. Nos. 3,107,056, 3,261,553, and 3,713,584 of Hunter. These sprinklers, however, are limited in scope; they generally do not throw water more than about 60 feet in any one direction.

Pop-up sprinklers are usually permanently installed in the ground of the golf course. Because of the expense of such installation, they usually are installed at least several hundred feet apart. Thus, even when all of the pop-up sprinklers on a fairway are operating, there are usually several areas of the golf course which are not watered.

It is an object of this invention to provide a process for extending the range of in-ground pop-up sprinklers so that more of the area of a golf course can be watered.

It is another object of this invention to provide more flexibility in the use of in-ground pop-up sprinklers so that additional, selected areas of the course may be watered.

SUMMARY OF THE INVENTION

In accordance with this invention, there is provided a process for sprinkling water onto a lawn, comprising the steps of: (a) providing an in-ground pop-up sprinkler comprised of a cylindrical housing, a motor compartment structure, and rotatable sprinkler head, wherein 1. said cylindrical housing has a sprinkler compartment, a motor compartment, and an inlet communicating with said motor compartment, 2. the bottom end of said cylindrical housing is closed except for said inlet, 3. above the bottom end of said cylindrical housing, the housing forms said motor compartment, 4. above said motor compartment, said housing is radially enlarged to form said sprinkler compartment, 5. said sprinkler head is capable of limited extension and retraction, 6. when retract, said sprinkler head is enclosed within said sprinkler head compartment formed within said housing, and 7. said sprinkler head is operatively connected to said motor compartment structure; (b) providing a valve and head sprinkler adaptor, wherein said adaptor is a circular sleeve comprised of a grooved orifice into which a pipe may be screwed and an O-ring groove around its perimeter, and wherein the diameter of said adaptor is substantially identical to the diameter of said motor compartment of said cylindrical housing; (c) removing said motor compartment structure and said rotatable sprinkler head from said cylindrical housing; (d) inserting an O-ring into said O-ring groove on said adaptor; (e) placing the adaptor with the O-ring inserted onto it into the motor compartment of said cylindrical housing; (e) attaching a pipe to said grooved orifice of said adaptor; and (f) supplying water to the inlet of said cylindrical housing.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENT

Figure 4:
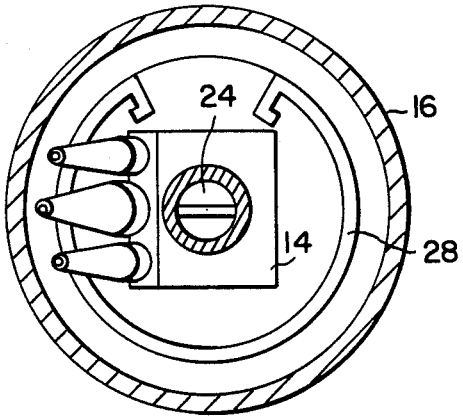
FIG. 4 PRIOR ART
FIG. 4 is a top view of the sprinkler of FIG. 1.

The adaptor of this invention is suitable for use with prior art pop-up sprinklers. Some of the pop-up sprinklers which are especially preferred for use with this adaptor include those described in U.S. Pat. No. 3,107,056 of Hunter, U.S. Pat. No. 3,261,552 of Hunter, and U.S. Pat. No. 3,713,584 of Hunter. The disclosure of each of these Hunter patents is hereby incorporated by reference into this specification.

U.S. Pat. No. 3,107,056 of Hunter discloses a sprinkler comprising a housing having a sprinkler compartment, a motor compartment an inlet communicating with said motor compartment, and a motor housing structure disposed within the motor compartment. The housing structure defines a major chamber adjacent to said inlet, a final gear chamber adjacent to said sprinkler compartment, a flow chamber between said motor chamber and final gear chamber, a primary gear chamber at one side of said flow chamber and also between said motor chamber and said gear chambers. The sprinkler also comprises an internal gear member mounted in said final gear chamber and including a tubular hub extending axially through said final gear chamber from said flow chamber; a sprinkler head connected with said hub to rotate with said internal gear; a turbine element in said turbine chamber, there being turbine inlet ports in the walls of said turbine chamber and passage means connecting said turbine chamber with said flow chamber for discharge of water through said sprinkler head; a gear train in said primary gear chamber operatively connected with said turbine elment; shiftable drive means in said final gear chamber operatively connected with said gear train and having alternatively operable terminal gears engageable with said internal gear to turn said internal gear in opposite directions; and means for shifting said drive means to cause operative engagement of either terminal gear with said internal gear.

In the operation of the sprinkler of U.S. Pat. No. 3,107,056, water enters upwardly through the inlet, then through tangential inlet ports of the turbine shell to drive the turbine wheel. Water then discharges from the turbine shell through apertures and a flow chamber, and then it flows upwardly through the sprinkler tube and discharges from the sprinkler nozzles. The force exerted by the water pressure is sufficient to overcome the weight of the nozzle block, nozzles, and cover plate so that the sprinkler tube moves to its upper position.

U.S. Pat. No. 3,261,552 of Hunter describes a preferred sprinkler structure which includes a housing having an inlet at its lower end and a cap at its upper end supported by a sprinkler head which is capable of limited extension and retraction. When retracted, the sprinkler head is enclosed within a sprinkler head compartment formed within the housing. Below the sprinkler head compartment the housing forms a motor compartment which receives a motor shell having a turbine drive and gear reduction means. The motor shell is provided with a partition forming the lower side of a sealed drive compartment. Centered in the drive compartment is a tubular sleeve which journals a tubular bearing; slideably mounted in the tubular bearing is a tubular stem, the upper end of which is connected to the sprinkler head and the lower end of which communicates with the inlet.

U.S. Pat. No. 3,713,584 of Hunter discloses a sprinkler comprised of a drive system for effecting rotation of the nozzle. This drive system includes a lower perforated plate for admitting water to the interior of the gear case. A haft supports a turbine wheel imediately above the perforated plate so that upwardly flowing water from the plate engages and drives the turbine wheel. The upper end of the shaft is provided with an initial drive gear. Gear shafts are provided which support a gear train comprising a plurality of gear units, each gear unit consisting of a pinion gear element and a spur gear, with the exception of the first gear unit, in which the larger lower gear is a ring gear.

Figure 1:
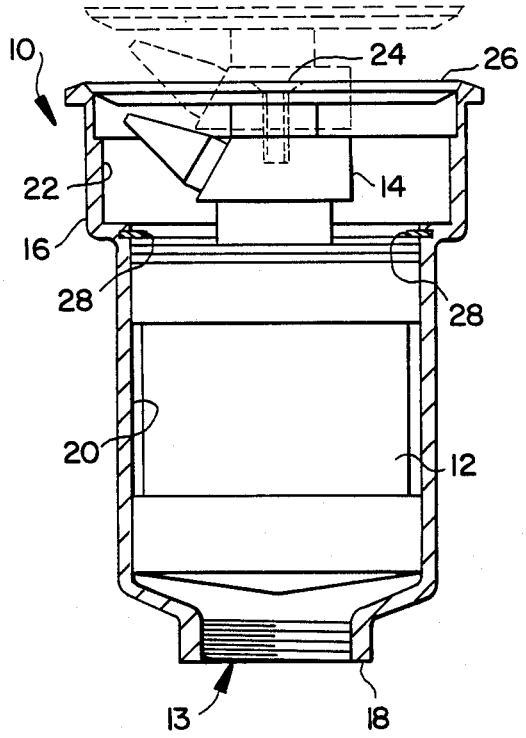
FIG. 1 PRIOR ART
FIG. 1 is sectional view of one preferred pop-up sprinkler used in the process of this invention.

FIG. 1 is simplified representation of the pop-up sprinkler of the Hunter patents. This pop-up sprinkler is usually in-ground, that is it is installed so that most of it is substantially below the surface of the area it is used to water. Sprinkler 10 can be connected to a source of water (not shown). Sprinkler 10 is comprised of a cylindrical housing, a motor housing structure 12, and a rotatable sprinkler head.

A preferred motor housing structure 12 is described in detail in U.S. Pat. Nos. 3,107,056 and 3,713,584. The former patent describes a motor housing structure defining a motor chamber, a gear train chamber, a flow chamber isolated from said gear train chamber, and an oscillator chamber; a fluid motor in said motor chamber; a gear train in said gear train chamber connected with said fluid motor and having an output shaft extending into said oscillator chamber; and an internal gear in said oscillator chamber including a tubular hub forming a bore communicating with said flow chamber and traversing said oscillator chamber to form a flow passage communicating with said flow chamber and isolated from said oscillator chamber. The latter patent indicates that the drive system in the motor housing structure includes a lower perforated plate for admitting water to the interior of the gear case. A shaft supports a turbine wheel imediately above the perforated plate so that upwardly flowing water from the plate engages and drives the turbine wheel. The upper end of the sha is provided with an inital drive gear. Gear shafts are provided which support a gear train comprising a plurality of gear units, each gear unit consisting of a pinion gear element and a spur gear, with the exception of the first gear unit, in which the larger lower gear is a ring gear with the drive gear engaging the internal teeth thereof. The gear units revolve on their respective shafts with the pinion gear elements of preceding gear units engaging the spur gear elements of succeeding gear units. The final drive system includes a shaft, the lower end of which has drivingly mounted thereon a gear which is driven by the aforementioned drive train. The upper end of the drive shaft is provided with a final drive gear, which gear serves to rotate the nozzle during operation.

Motor housing structure 12 is operatively connected to rotatable sprinkler head 14. One preferred rotatable sprinkler head 14 is described in, e.g., U.S. Pat. Nos. 3,107,056 which describes a sprinkler head rotatable with said internal gear communicating with said flow passage; a frame oscillatably mounted in said osciallator chamber for movement about said drive output; a gear set carried by said frame andincluding a driving gear connected wtih said output shaft and a pair of terminal gears at opposite sides of said driving gear connected with said output shaft and a pair of terminal gears at opposite sides of said drive gear and rotatable in opposite directions; a nonadjustable stop fixed to said internal gear and positioned for engagement by said trigger arm; interengaging means incorporating said internal gear and shell, tending to fix said shell and its stop relative to said internal gear; and manually operable means for restraining said shell, to permit relative rotation of said internal gear, thereby to shift the position of said adjustable stop relative to said nonadjustrable stop.

Both motor housing 12 and rotatable sprinkler 41 are contained in cylindrical housing 16. The bottom end 18 of housing 16 is closed except for an inlet 13. Above the bottom end 18 the housing forms a motor compartment 20 and, above the motor compartment, the housing is radially enlarged to form a sprinkler compartment 22.

Figure 3:
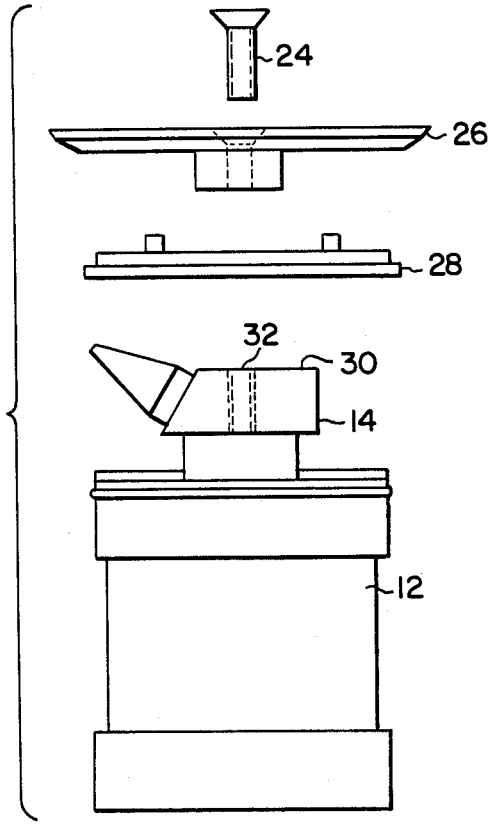
FIG. 3 is an exploded view of the motor compartment, sprinkler head, retaining ring, cover plate, and screw of the sprinkler of FIG. 1 after they have been removed from the cylindrical housing of said sprinkler.
Figure 2:
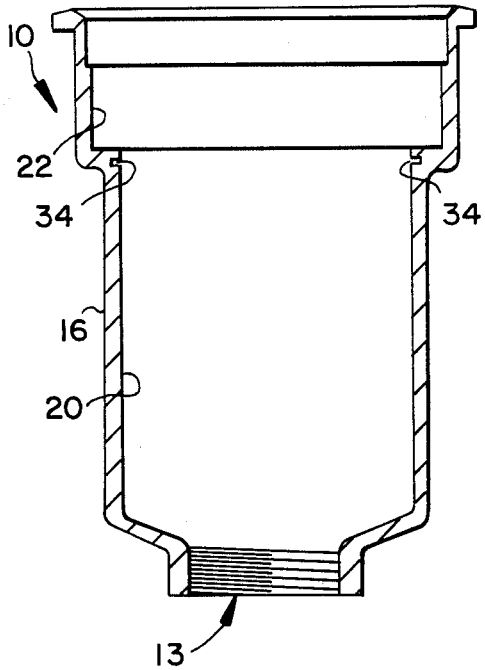
FIG. 2 is a sectional view of the cylindrical housing of the sprinkler of FIG. 1 from which the motor compartment and the sprinkler head have been removed.

Empty cylindrical housing 16 is shown in FIG. 2. In the process of this invention, as is illustrated in FIG. 3, motor compartment 12 and rotatable sprinkler 14 are removed from cylindrical housing 16 prior to the installation of the adaptor of this invention. In order to remove these components, screw 24 is first removed from the top of the pop-up sprinkler. Screw 24 attaches cover plate 26 to the nozzle block 30 of rotable sprinkler 14; screw 24 is screwed into threaded orifice 32 in nozzle block 30. Split retainer ring secures motor housing structure 12 to cylindrical housing 16 via internal groove 34; it also is removed prior to the installation of the adaptor.

FIG. 4 is a top view of rotatable sprinkler 14.

Figure 5:
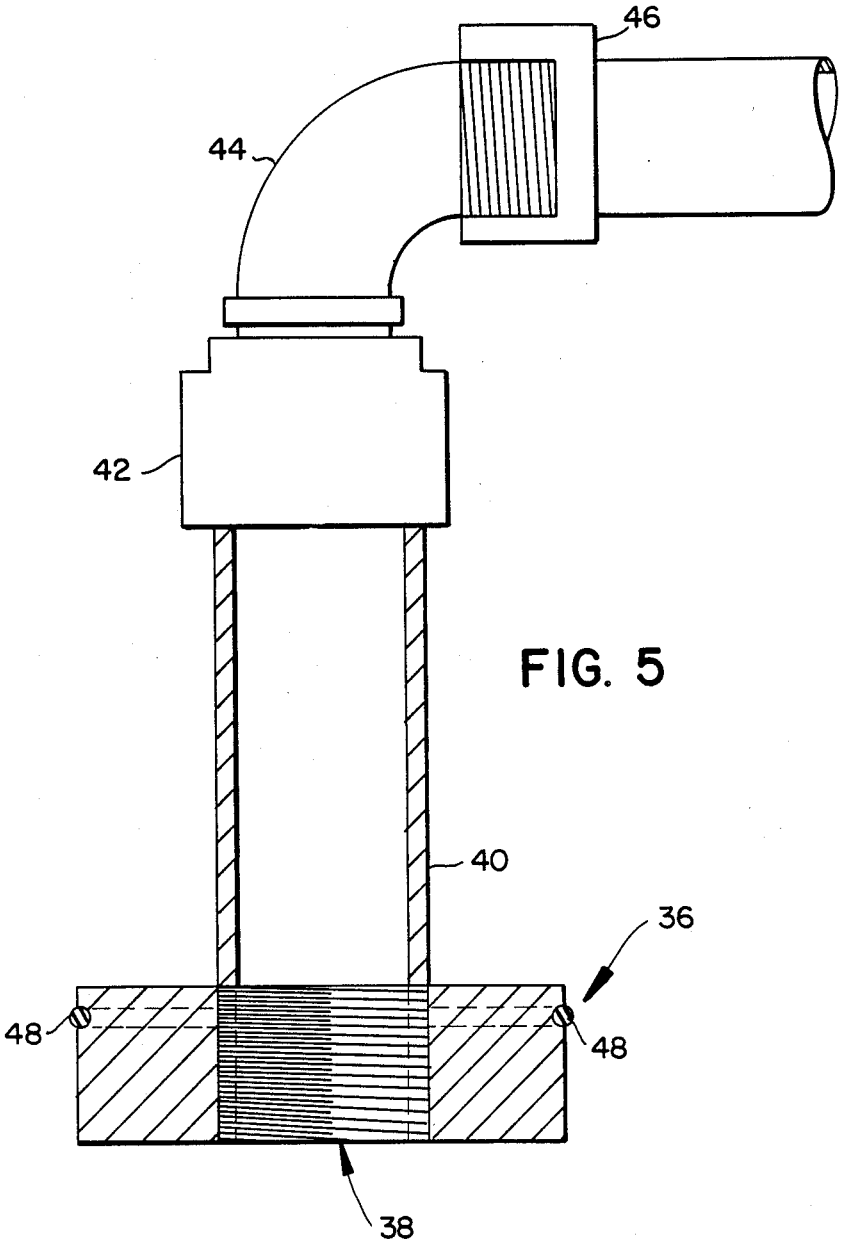
FIG. 5 is a sectional view of the adaptor of this invention to which has been connected a pipe, a rotary union, and an elbow.
Figure 6:
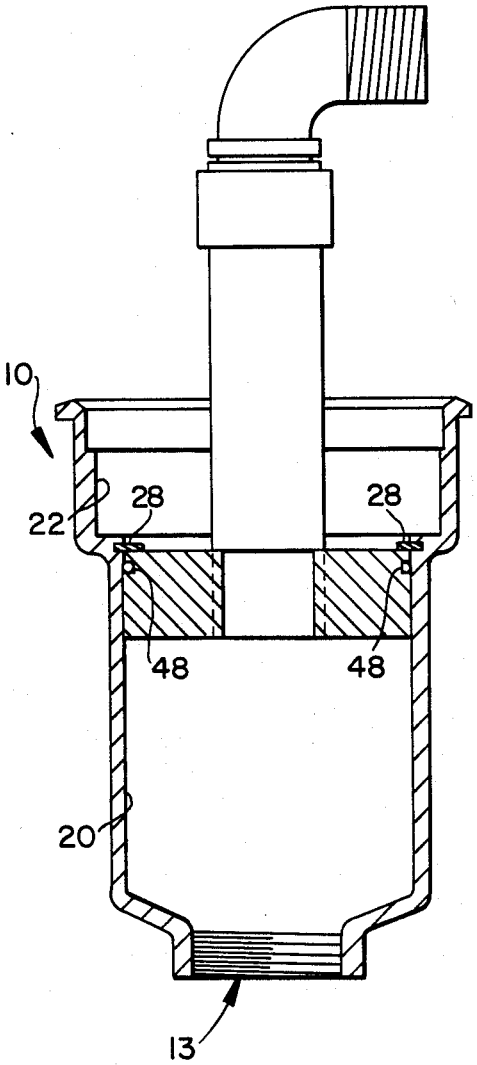
FIG. 6 is a sectional view of the adaptor of FIG. 5 in place in the cylindrical housing of FIG. 2.
Figure 7:
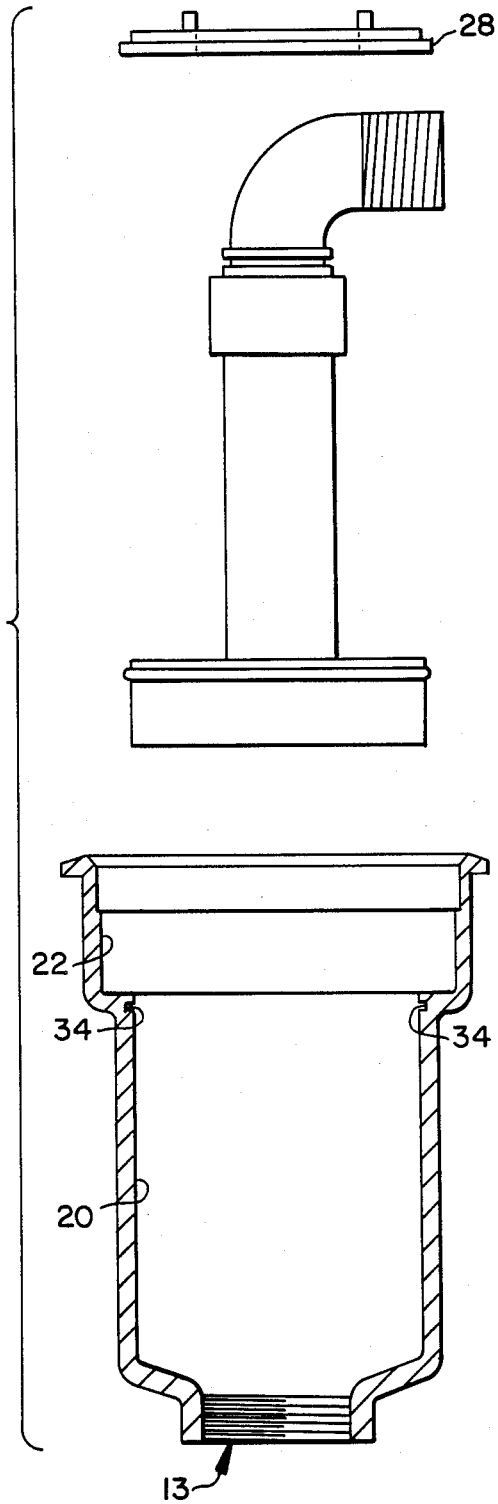
FIG. 7 is an exploded view illustrating how the adaptor of FIG. 5 is placed into the housing of FIG. 2.
Figure 8:
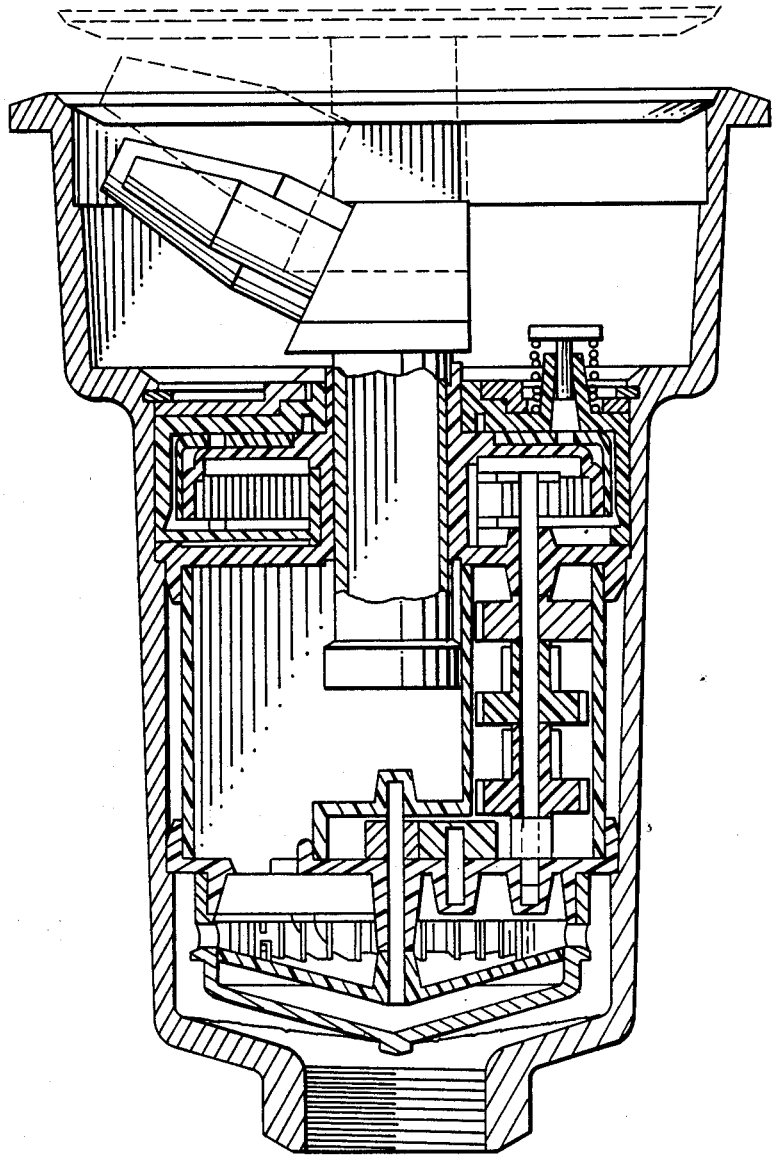
FIG. 8 PRIOR ART
FIG. 8 is a sectional view of the pop-up sprinkler of FIG. 1.

FIG. 5 is a cross-sectional view of a preferred embodiment of a valve and head sprinker adaptor for the pop-up sprinkler described above. This adaptor allows one to water more and/or greater selected areas of a lawn in which the pop-up sprinkler is located. The term lawn, as used in this specification, refers to a plot or area planted with grass and/or similar plants.

Adaptor 36 is comprised of grooved orifice 38 into which pipe 40 may be screwed. A rotary union 42, to which is attached an elbow such as, e.g., ninety-degree elbow 44, may then secured to pipe 40 by conventional means; in the embodiment illustrated in FIG. 5, internal threads on one end of rotary union 42 and external threads on one end of pipe 40 are used to attach rotary union 42 to pipe 40. After the rotary union has been connected, a hose may be connected to the union and the water supply to the sprinkler may be turned on.

In another embodiment, not illustrated, pipe 40 is connected directly to a hose without the use of a rotary union.

Once adaptor 36 hs been attached to cylindrical housing 16, and a hose has been attached to end of elbow 44, one can rotate the elbow and the hose to which it is attached a full 360 degrees thereby being able to use it over the widest possible area.

Other means may be used to connect the water flowing through pipe 40 to rotary union 42 and 90 degree elbow 44, as long as the means allow communication between said pipe and rotary union and elbow, and as long as the means allow complete rotation of the rotary union.

Adaptor 36 is preferably cylindrical with a diameter substantially identical to the diameter of chamber 20 of motor compartment 20. In one embodiment, said diameter is about 3.19 inches. In another embodiment, said diameter is about 3 inches. In general, one can use a range of diameters of from about 2 to about 5 inches. A diameter of from about 2.5 to about 3.5 inches is preferred.

The diameter of orifice 38 will usually be from about 0.75 to about 2.0 inches.

The width of adaptor 36 will usually range from about 0.75 to about 1.5 inches.

In one preferred embodiment, adaptor 36 consists essentially of aluminum. In another preferred embodiment, the adaptor is made out of a material selected from the group consisting of durable plastic, steel, and the like.

Adaptor 36 contains an O-ring groove (not shown), which extends radially around the perimeter of the adaptor. Prior to the time adaptor 36 is placed into the motor compartment of the cylindrical housing, an O-ring 48 is placed into the groove. This O-ring supports adaptor 36 in the motor compartment and insures that water flowing through the inlet of the cylindrical housing does not pass around the outer surfaces of the adaptor.

The following example is presented to illustrate the claimed invention but is to be deemed limitative thereof.

EXAMPLE

A bar of aluminum with a diameter of about 3.25 inches is turned on a lathe, and about 0.06 inches of the external diameter is removed. Thereafter, the end of the bar is faced by a suitable cutting tool. Thereafter, about a 1.18 diameter hole is drilled and bored through the center of the bar, and suitable internal threads are turned therein. Thereafter, an O-ring groove is cut which is about 0.12 inches deep and about 0.12 inches wide on the perimeter of the bar; the groove is cut about 0.12 inches from the face of the bar. Thereafter, the adaptor is then cut off to a length of about 1.0 inch.

A pipe with a 1.25 inch external diameter and a 1.0 internal diameter which is about 6.0 inches long is then screwed into the grooved orifice of the adaptor. Thereafter, an elbow-rotary union assembly is attached to the end of the pipe; the elbow used in this example is "Royal Coach Model 45001, Fresno, California".

The adaptor to which the pipe, rotary union, and elbow have been attached, is then placed into in-ground pop-up "Toro Turf Sprinkler" with a geared rotor and a model 654 head, which is sold by the Toro Manufacturing Company. Thereafter, a hose is connected to the end of the elbow, and the water supply to the pop-up sprinkler is turned on.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A process for sprinkling water onto a lawn, comprising the steps of:

(a) providing an in-ground pop-up sprinkler comprised of a cylindrical housing, a motor compartment structure, and rotatable sprinkler head, wherein:

1. said cylindrical housing has a sprinkler compartment, a motor compartment, and an inlet communicating with said motor compartment,
2. the bottom end of said cylindrical housing is closed except for said inlet,
3. above the bottom end of said cylindrical housing, the housing forms said motor compartment.
4. above said motor compartment, said housing is radially enlarged to form said sprinkler compartment,
5. said sprinkler head is capable of limited extension and retraction,
6. when retracted, said sprinkler head is enclosed within said sprinkler head compartment formed within said housing, and
7. said sprinkler head is operatively connected to said motor compartment structure;

(b) providing a valve and head sprinkler adaptor, wherein said adaptor is a circular sleeve comprised of a grooved orifice into which a pipe may be screwed and an O-ring groove around its perimeter, and wherein the diameter of said adaptor is substantially identical to the diameter of said motor compartment of said cylindrical housing;

(c) removing said motor compartment structure and said rotatable sprinker head from said cylindrical housing;

(d) inserting an O-ring into said O-ring groove on said adaptor;

(e) placing the adaptor with the O-ring inserted onto it into the motor compartment of said cylindrical housing;

(e) attaching a pipe to said grooved orifice of said adaptor; and (f) supplying water to the inlet of said cylindrical housing.

2. The process as recited in claim 1, wherein, after said pipe is attached to said grooved orifice of said adaptor, a rotary union is attached to said pipe.

3. The process as recited in claim 2, wherein said motor compartment structure is comprised of a turbine drive and gear reduction means.

4. The process as recied in claim 3, wherein said motor compartment structure is disposed within said motor compartment.

5. The process as recited in claim 4, wherein said motor housing structure defines a major chamber adjacent to said inlet, a final gear chamber adjacent to said sprinkler compartment, a flow chamber between said motor chamber and said final gear chamber, and a primary gear chamber at one side of said flow chamber and also between said motor chamber and said gear chambers.

6. The process as recited in claim 5, wherein said sprinkler comprises an internal gear member mounted in said final gear chamber.

7. The process as recited in claim 6, wherein said sprinkler comprises a tubular hub extending axially through said final gear chamber from said flow chamber.

8. The process as recited in claim 7, wherein said sprinkler head is connected with said hub to rotate with said internal gear.

9. The process as recited in claim 8, wherein said sprinkler comprises a turbine element in a turbine chamber.

10. The process as recited in claim 9, wherein there are turbine inlet ports in the walls of said turbine chamber and passage means connecting said turbine chamber with said flow chamber for discharge of water through said sprinkler head.

11. The process as recited in claim 10, wherein said sprinkler comprises a gear train in said primary gear chamber.

12. The process as recited in claim 11, wherein said gear train in said primary gear chamber is operatively connected with said turbine element.

13. The process as recited in claim 12, wherein said sprinkler comprises shiftable drive means in said final gear chamber operatively connected with said gear train.

14. The process as recited in claim 13, wherein said hiftable drive means has alternatively operable terminal gears engageable with said internal gear.

15. The process as recited in claim 14, wherein said sprinkler comprises means for shifting said drive means to cause operative engagement of either terminal gear with said internal gear.

* * * * *